US007104317B2

(12) United States Patent
Richard et al.

(10) Patent No.: US 7,104,317 B2
(45) Date of Patent: Sep. 12, 2006

(54) EXPANDABLE COMPOSITION TUBULARS

(75) Inventors: Bennett M. Richard, Kingwood, TX (US); Peter Aronstam, Houston, TX (US); Larry A. Watkins, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 271 days.

(21) Appl. No.: 10/675,345

(22) Filed: Sep. 30, 2003

(65) Prior Publication Data

US 2004/0108626 A1 Jun. 10, 2004

Related U.S. Application Data

(60) Provisional application No. 60/430,864, filed on Dec. 4, 2002.

(51) Int. Cl.
*E21B 43/10* (2006.01)

(52) U.S. Cl. ..... 166/207

(58) Field of Classification Search ..... 166/207, 166/277, 242.2, 230
See application file for complete search history.

(56) References Cited

U.S. PATENT DOCUMENTS

| | | | | |
|---|---|---|---|---|
| 3,203,451 | A | 8/1965 | Vincent | |
| 3,203,483 | A * | 8/1965 | Renic | 166/207 |
| 4,752,431 | A | 6/1988 | Knowles | |
| 5,454,419 | A | 10/1995 | Vloedman | |
| 5,494,106 | A * | 2/1996 | Gueguen et al. | 166/277 |
| 5,634,743 | A | 6/1997 | Chandler | |
| 5,695,008 | A | 12/1997 | Bertet et al. | |
| 5,925,409 | A | 7/1999 | Nava | |
| 6,089,320 | A | 7/2000 | LaGrange | |
| 6,401,815 | B1 * | 6/2002 | Surjaatmadja et al. | 166/277 |
| 6,435,281 | B1 * | 8/2002 | Baugh | 166/382 |
| 2001/0010781 | A1 | 8/2001 | Prusak | |
| 2002/0111434 | A1 * | 8/2002 | White et al. | 525/242 |

FOREIGN PATENT DOCUMENTS

| | | |
|---|---|---|
| DE | 3732694 A1 | 4/1989 |
| WO | WO 93/15131 | 8/1993 |
| WO | WO 00/61914 | 10/2000 |
| WO | WO 02/064653 A2 | 8/2002 |

OTHER PUBLICATIONS

Database WPI, Section CH, Week 199315, Derwent Publications Ltd, London, GB; Class H01, An 1993-124895, XP00282757 & SU 1730429 A (Turkmennipineft Oil Iïd Inmst), Apr. 30, 1992 Abstract.
Leonard Le Blanc: Part II: "Smart Metals" Providing Actuation, Sealing, and Connection Functions Downhole, Offshore, vol. 62 No. 1, Jan. 2002, pp. 54, 56, 77, XP002282756, ISSN: 00300608, 6 pages.

(Continued)

*Primary Examiner*—David Bagnell
*Assistant Examiner*—Daniel P Stephenson
(74) *Attorney, Agent, or Firm*—Steve Rosenblast

(57) ABSTRACT

Composite tubulars that have not been polymerized and are thus flexible enough to be coiled are delivered into a wellbore and expanded. The expansion occurs from an external catalyst such as heat or releases the internal catalyst and allows the expanded tubular to become rigid. Optionally, healing agents can be imbedded in the tubular wall to be released to seal subsequently forming cracks.

21 Claims, 2 Drawing Sheets

OTHER PUBLICATIONS

Michael Tupper, et al.; "Developments in Elastic Memory Composite Materials for Spacecraft Deployable Structures," IEEE, 2001, 7 pages.
"Plastics that can heal themselves," R & D Magazine, Jul. 2002, 13.
C. Liang, et al.; "Investigation of Shape Memory Polymers and Their Hybrid Composites," Journal of Intelligent Materials Systems and Structures, Apr. 1997, vol. 8, 380-386.
Thomas W. Murphey, et al.; "Some Micromechanics Considerations of the Folding of Rigidizable Composite Materials," American Institute of Aeronautics and Astronautics; paper 2001-1418 Apr. 2001 1762-1772.
Wolfgang G. Knauss; "Perspectives in Experimental Solid Mechanics," International Journal of Solids and Structures 37, 2000, 251-266.

* cited by examiner

EXPANDABLE COMPOSITION TUBULARS

PRIORITY INFORMATION

This application claims the benefit of U.S. Provisional Application No. 60/430,864 on Dec. 4, 2002.

FIELD OF THE INVENTION

The field of this invention relates to tubulars that are expanded downhole and more particularly to composite tubulars that can be expanded wherein the expansion triggers a polymerization reaction to lend rigidity to the expanded tubular or the reaction is otherwise triggered independent of the expansion.

BACKGROUND OF THE INVENTION

Expanding metallic tubulars downhole has become more common. Casing, slotted liners and screens have been expanded using a variety of techniques involving fluid pressure or a swage. The expansion of tubulars has to date excluded the use of composites. Composites offer advantages of light weight, good chemical and thermal resistance properties, and low cost. The problem with composites and other non-metallics is that they are too brittle to withstand significant expansions that would make them useful in a downhole application where expansion was contemplated when used in the finished form in which such tubular goods are currently available.

Attempts to use composites in the past were in applications that were not readily adapted for downhole use for a variety of reasons. A good example is U.S. Pat. No. 4,752,431. In this reference, the tubular is provided in a limp condition and unrolled. It comprises a sandwich of a cement layer between two layers that could be flexible plastic, rubber or canvas. When water or steam is circulated, the limp tubular assumes a cylindrical shape and the cement sets to provide rigidity. The application of this technology is for lining existing pipes such as those that cross under roads. Another stated advantage is that the limp pipe can follow the contour of the land and then be hardened when pressurized with water.

U.S. Pat. No. 5,634,743 uses a flexible lining that contains a curable synthetic resin in conjunction with a device advanced with the lining to apply ultrasonic energy to the leading end of the lining, as the lining is unfurled along the center of the pipe to be lined. Expansion is not contemplated in this process.

U.S. Pat. No. 5,925,409 shows a multi step procedure where a resin containing hydrogen is reacted with a polycarbodiimide to make a tube that can be inserted into another tube for the purpose of lining it. The inner tube is inflated to contact the outer tube and then cured in place with hot air or water, electricity or radiation. The liner tube is inflated as opposed to expanded. A similar concept is employed in German Application DE 3732694 A1.

U.S. application U.S. 2001/0010781 A1 involves putting cables in a strip and then inflating a liner over the strip. The final step is to set the body with hot water in the liner or heat from cables that run through the body.

In WO 93/15131 a technique for lining sewer pipes and the like is illustrated where the liner is applied followed by the application of ultrasonic energy to liberate microencapsulated catalyst. Alternatively, iron oxide particles are incorporated in the resin and are caused to heat by applying electromagnetic energy. No expansion is contemplated. Related to this technique are U.S. Pat. Nos. 4,064,211; 4,680,066; 4,770,562.

Elastic Memory Composites and their ability to be deformed on heating and to hold the deformed shape on subsequent cooling, have been described in a paper published by IEEE in 2001 entitled Developments in Elastic Memory Composite Materials for Spacecraft Deployable Structures. These materials resume their original shape when reheated. More recently, R&D Magazine published in the July 2002 issue on page 13, an article describing the ability of a composite tube to fix stress cracks that form by liberation of an encapsulated compound as a result of the crack formation. Shape memory materials and some of their uses are described in an article by Liang, Rogers and Malafeew entitled Investigation of Shape Memory Polymers and their Hybrid Composites which appeared in the April 1997 edition of the Journal of Intelligent Materials Systems and Structures. Also of interest is American Institute of Aeronautics and Astronautics paper 2001-1418 entitled Some Micromechanics Considerations of the Folding of Rigidizable Composite Materials.

The object of this invention is to employ non-traditional materials for well tubulars by taking advantage of their properties to allow the tubular to be rapidly deployed into a wellbore and then expanded in place. The expansion can trigger a reaction that will harden the tubular in place to allow it to function downhole. Alternatively, the reaction can be otherwise triggered and the tubular expanded. Additionally, healing agents can also be encapsulated in the tubular to heal subsequently forming cracks that may develop during the service life of the expanded tubular. While composites that are flexible until a reaction occurs are envisioned as the preferred material, other materials are envisioned that preferably can be coiled with the catalyst encapsulated and that become rigid on expansion with the liberation of the catalyst. These and other advantages of the present invention will become more apparent to those skilled in the art from a review of the description of the preferred embodiment and claims, below.

SUMMARY OF THE INVENTION

Composite tubulars that have not been polymerized and are thus flexible enough to be coiled are delivered into a wellbore and expanded. The expansion occurs from an external catalyst such as heat or releases the internal catalyst and allows the expanded tubular to become rigid. Alternatively, the reaction can be triggered independently of the expansion. Optionally, healing agents can be imbedded in the tubular wall to be released to seal subsequently forming cracks.

DETAILED DESCRIPTION OF THE PREFERRED EMBODIMENT

Figure 1:
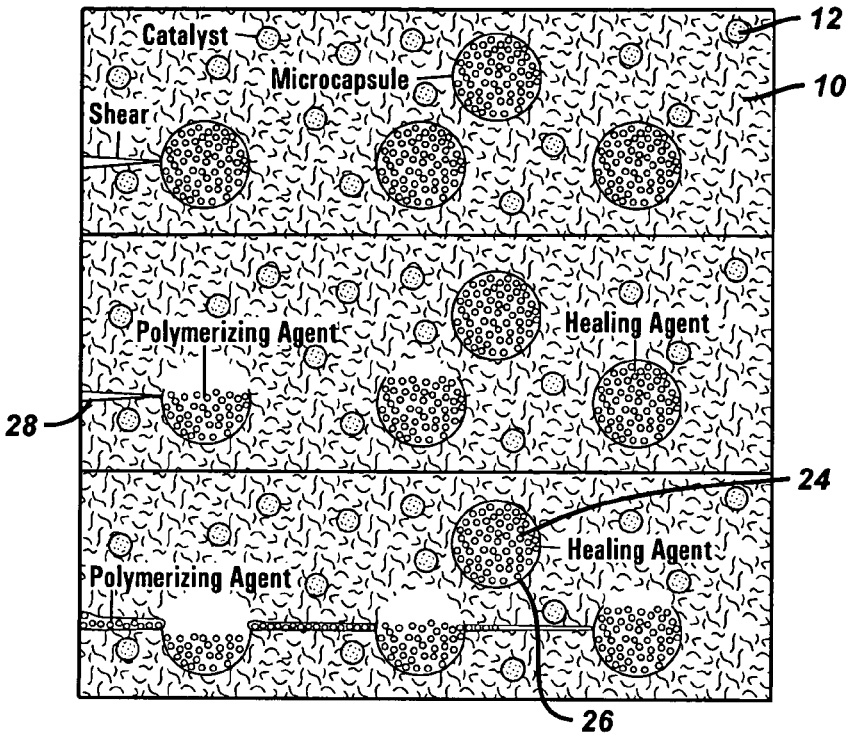
FIG. 1 is a schematic representation of the wall of the tubular showing the catalyst that can be released on expansion and healing agent that can subsequently be released to fill stress cracks.
Figure 2:
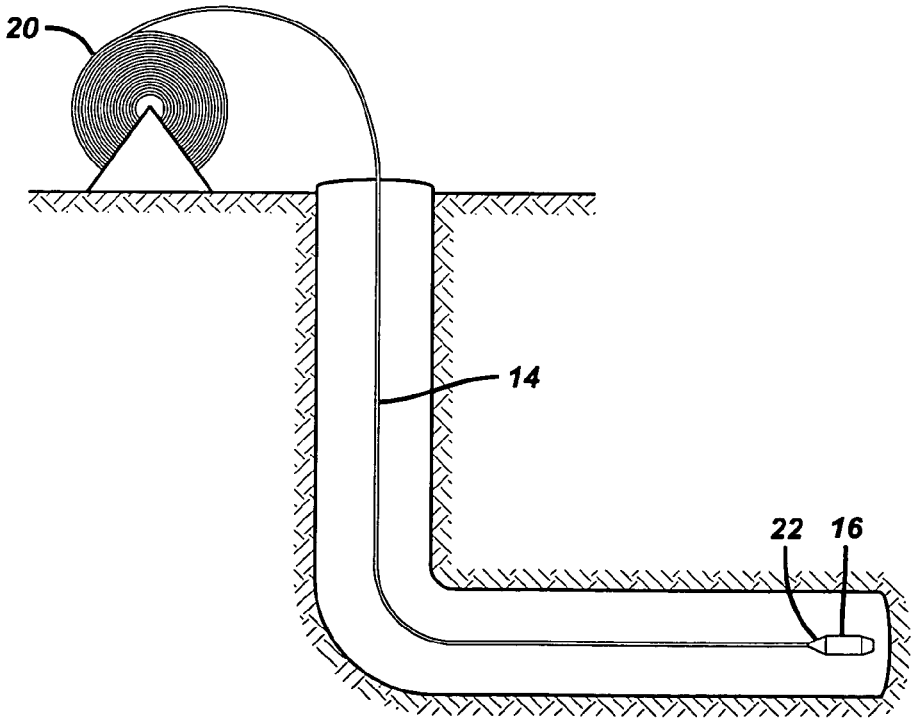
FIG. 2 is a schematic view of the tubing fed into a wellbore off of a reel prior to expansion.
Figure 3:
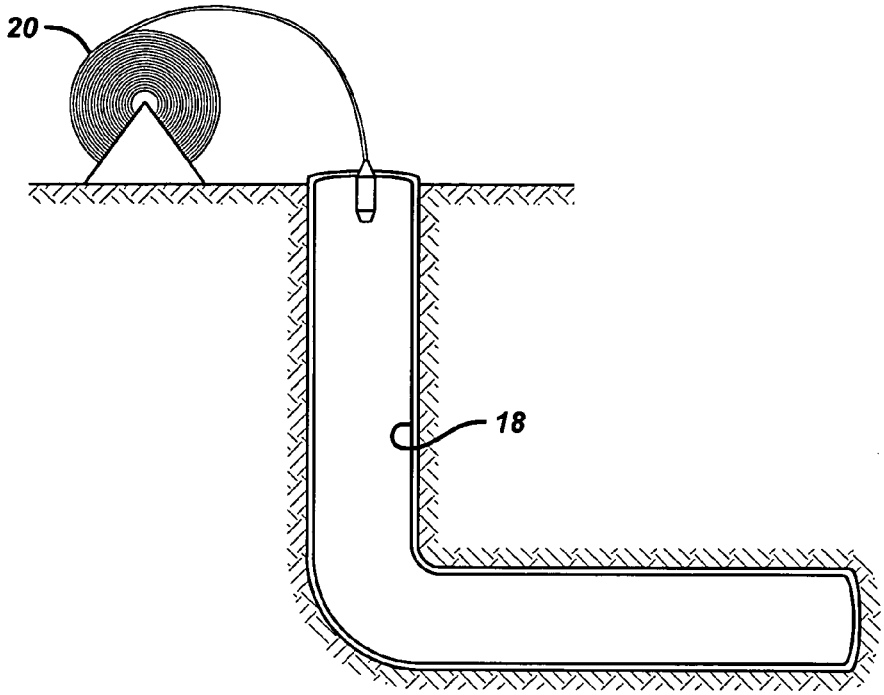
FIG. 3 is the view of FIG. 2 shown after the tubing is expanded and made rigid from the expansion.
Figure 4:
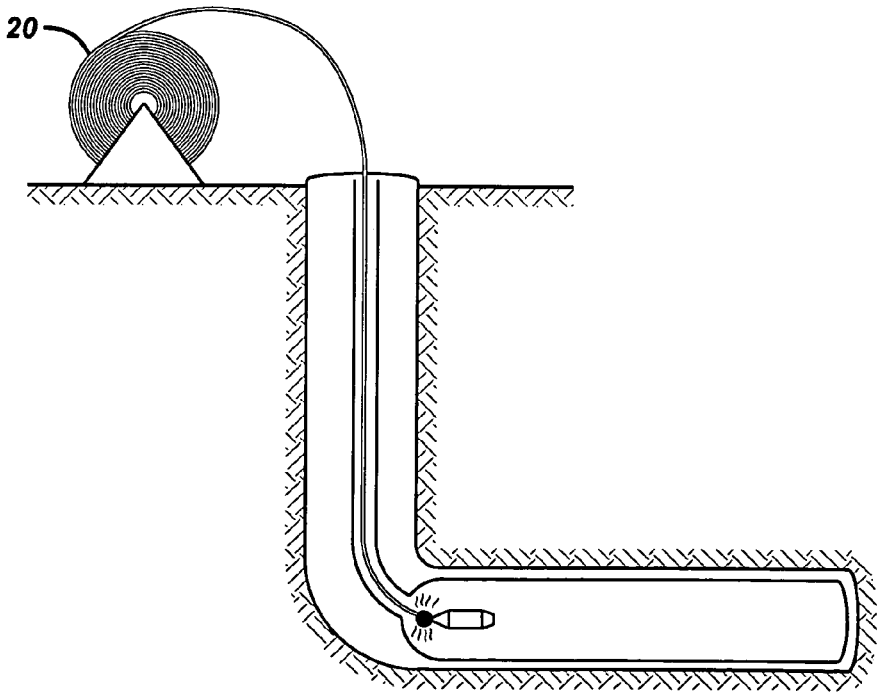
FIG. 4 shows release of the catalyst occurring independently of expansion with a swage as the swage is advanced.

FIG. 1 shows a schematic representation of a wall of a tubular that is preferably a composite epoxy resin system composed of a fiber material 10 and further featuring encapsulated catalysts and hardeners 12 that are liberated when the tubular 14 is placed downhole as shown in FIG. 2 and then expanded by any one of a variety of known techniques such as by a swage 16. It should be noted that the tubular that is initially in a flexible state can be reshaped to its original dimension without being expanded in the context used herein. Expansion is an increase in size above the original dimension when in the flexible state, regardless of the manner such increase in dimension is accomplished. After expansion, the encapsulated catalyst is liberated and a hardening reaction takes place. Alternatively, the reaction can be instigated by a mechanism independent of the expansion or the two events can occur contemporaneously. For example, an energy source such as electromagnetic, acoustic, or nuclear can be secured to an advancing swage where the source triggers the reaction in the tubular by permitting the catalyst to operate to trigger the reaction and the swage 16 expands the tubular. In that instance, the two events would occur contemporaneously rather than one triggering the other. This mode of operation is shown in FIG. 4. The formerly limp tubular, that can optionally be lined with a metallic sacrificial inner sleeve 18 comes off a reel 20 and can be rapidly deployed downhole. It can advance due to its weight or it can have assistance in the form of known tools that employ anchors and a telescoping assembly to crawl downhole taking with it the leading end 22 of the tubular 14. The tubular 14 can also be partially or fully inflated to its original maximum dimension for insertion but not expanded. When it is in position, it can be expanded to trigger the release of the catalyst to begin the hardening of the tubular 14. The catalyst and/or hardening agents can be selected for the expected temperatures and the desired final mechanical properties with materials currently available from General Pacific Chemical. Optionally, a healing agent 24 can be encapsulated 26 in a manner that will retain the healing agent even despite prior expansion. Only a subsequently formed stress crack 28 will allow the healing agent 24 to flow into it to seal it up. The encapsulation 26 for the healing agent 24 will thus need to be severed or otherwise defeated. Simple expansion of the tubular 14 will release the catalyst 12 so that a reaction will commence with the fiber reinforced epoxy material that forms the tubular 14. The liner 18 can remain intact or actually rip during the expansion. Optionally, liner 18 may be fully omitted.

The catalyst 12 can be tied up in the wall of the tubular in a physical or chemical way and can be liberated at the required time in a variety of techniques. The encapsulation of the catalyst can be defeated to trigger the desired hardening reaction by applying nuclear, magnetic, electric or electromagnetic energy or light radiation or the addition of or exposure to a chemical. Yet other ways include applied force or pressure or the introduction of a chemical to break the encapsulation for the catalyst. The catalyst can be selectively deposited to straddle the expected pay zones so that in the region of expected production the tubular will remain unhardened and could permit production while above or below that zone the expanded tubular is hardened to preclude production or channeling between zones. The healing agent 24 can be similarly distributed.

The fracture-healing feature is an adaptation of the process developed at the University of Illinois, Champaign-Urbana and adapted to a tubular structure for downhole use.

Those skilled in the art will appreciate that the light weight and corrosion resistance of composites are advantages in wellbore applications. Previously, the brittle nature of fully formed composite tubes has precluded their use downhole, where expansion was contemplated. However, by delaying the polymerization reaction the tubular 14 can be delivered to the desired location and expanded without the fear of cracking. The act of expansion triggers the reactions to allow the tubular to develop full strength. The expansion also allows the tubular 14 to conform to the shape of a surrounding tubular or the borehole, within limits, before the reaction bringing it to full strength commences.

Alternatively, the tubular 14 can be made of a shape memory material that originally has a desired final diameter. The preformed material is heated under an applied force to alter its shape and then cooled to be able to advance it into the wellbore. After being advanced into the wellbore, the downhole temperature or additional supplied heat causes the material to resume its original shape at the desired diameter downhole. This approach adapts a spacecraft application of such materials to a tubular structure for downhole use. It should be noted that expansion is not required as the original tubular shape is already of the desired dimension, without expansion. However, to the extent that the elastic memory composite can withstand expansion forces, then some expansion can also be undertaken.

The foregoing disclosure and description of the invention are illustrative and explanatory thereof, and various changes in the size, shape and materials, as well as in the details of the illustrated construction, may be made without departing from the spirit of the invention.

We claim:

1. A method of installing a tubular string defined by a wall in a wellbore, said string capable of being put into an initial cylindrical dimension, comprising:

installing the tubular string into position in the wellbore while the tubular string is in a flexible to the touch condition;

expanding the tubular string beyond said initial cylindrical dimension;

making said wall more rigid as a direct result of said expanding.

2. The method of claim 1, comprising:

making said tubular string from a non-metallic material.

3. The method of claim 2, comprising:

storing a catalyst for a hardening reaction in the wall of said tubular string.

4. The method of claim 3, comprising:

promoting a reaction with said catalyst from said expanding.

5. The method of claim 3, comprising:

making the tubular string from a composite epoxy resin and a fiber material.

6. The method of claim 3, comprising:

releasing said catalyst independently of said expanding.

7. The method of claim 6, comprising:

accomplishing said independent releasing while expanding.

8. The method of claim 1, comprising:

providing a liner within said tubular string.

9. The method of claim 8, comprising:

making said liner from a metallic material.

10. A method of installing a tubular string defined by a wall in a wellbore, said string capable of being put into an initial cylindrical dimension, comprising:

installing the tubular string into position in the wellbore while the tubular string is in a flexible to the touch condition;

expanding the tubular string beyond said initial cylindrical dimension;

making said wall more rigid as a direct result of said expanding;

inflating the tubular after positioning it in the wellbore to point short of expansion.

11. A method of installing a tubular string defined by a wall in a wellbore, said string capable of being put into an initial cylindrical dimension, comprising:

installing the tubular string into position in the wellbore while the tubular string is in a flexible to the touch condition;

expanding the tubular string beyond said initial cylindrical dimension;

making said wall more rigid as a direct result of said expanding;

unrolling the tubular string from a coil prior to insertion into the wellbore.

12. A method of installing a tubular string in a wellbore, comprising:

installing the tubular string into position in the wellbore while the tubular string is in a flexible condition;

expanding the tubular string;

making the tubular string more rigid;

providing a liner within said tubular string;

making said liner from a metallic material;

making said liner sacrificial upon said expanding.

13. A method of installing a tubular string defined by a wall in a wellbore, said string capable of being put into an initial cylindrical dimension, comprising:

installing the tubular string into position in the wellbore while the tubular string is in a flexible to the touch condition;

expanding the tubular string beyond said initial cylindrical dimension;

making said wall more rigid as a direct result of said expanding;

providing a healing agent for sealing cracks in the wall of said tubular string.

14. The method of claim 13, comprising:

encapsulating said healing agent during said expanding.

15. The method of claim 13, comprising:

liberating said healing agent as a result of crack formation in the wall of said tubular string in the vicinity of where said healing agent is stored.

16. A method of installing a tubular string defined by a wall in a wellbore, said string capable of being put into an initial cylindrical dimension, comprising:

installing the tubular string into position in the wellbore while the tubular string is in a flexible to the touch condition;

expanding the tubular string beyond said initial cylindrical dimension;

making said wall more rigid as a direct result of said expanding;

making said tubular string from a non-metallic material;

storing a catalyst for a hardening reaction in the wall of said tubular string;

making the tubular string from a composite epoxy resin and a fiber material;

providing a healing agent for sealing cracks in the wall of said tubular string;

liberating said healing agent as a result of crack formation in the wall of said tubular string in the vicinity of where said healing agent is stored.

17. A method of installing a tubular string defined by a wall in a wellbore, said string capable of being put into an initial cylindrical dimension, comprising;

installing the tubular string into position in the wellbore while the tubular string is in a flexible to the touch condition;

expanding the tubular string beyond said initial cylindrical dimension;

making said wall more rigid as a direct result of said expanding;

making said tubular string from a non-metallic material;

storing a catalyst for a hardening reaction in the wall of said tubular string;

making the tubular string from a composite epoxy resin and a fiber material;

performing said expanding without cracking the wall of said tubular string.

18. A method of installing a tubular string in a wellbore, comprising:

installing the tubular string into position in the wellbore while the tubular string is in a flexible condition;

expanding the tubular string;

making the tubular string more rigid;

making said tubular string from a non-metallic material;

storing a catalyst for a hardening reaction in the wall of said tubular string;

releasing said catalyst independently of said expanding;

accomplishing said independent releasing while expanding;

expanding with a swage;

attaching the source for said releasing to said swage.

19. A method of installing a tubular string defined by a wall in a wellbore, said string capable of being put into an initial cylindrical dimension, comprising:

installing the tubular string into position in the wellbore while the tubular string is in a flexible to the touch condition;

expanding the tubular string beyond said initial cylindrical dimension;

making said wall more rigid as a direct result of said expanding;

making said tubular string from a non-metallic material;

storing a catalyst for a hardening reaction in the wall of said tubular string;

releasing said catalyst with at least one of nuclear, magnetic, electric or electromagnetic energy or light radiation or the addition of or exposure to a chemical.

20. A method of installing a tubular string in a wellbore, comprising:

installing the tubular string into position in the wellbore while the tubular string is in a flexible condition;

expanding the tubular string;

making the tubular string more rigid;

making said tubular string from a non-metallic material;

storing a catalyst for a hardening reaction in the wall of said tubular string;

selectively depositing said catalyst outside of expected pay zones in the tubular.

21. A method of installing a tubular string in a wellbore, comprising:

installing the tubular string into position in the wellbore while the tubular string is in a flexible condition;

expanding the tubular string;

making the tubular string more rigid;

making said tubular string from a non-metallic material;

storing a catalyst for a hardening reaction in the wall of said tubular string;

making the tubular string from a composite epoxy resin and a fiber material;

providing a healing agent for sealing cracks in the wall of said tubular string;

liberating said healing agent as a result of crack formation in the wall of said tubular string in the vicinity of where said healing agent is stored;

selectively depositing said healing agent outside of expected pay zones in the tubular.

* * * * *